US011649835B2

(12) United States Patent
Haime et al.

(10) Patent No.: US 11,649,835 B2
(45) Date of Patent: May 16, 2023

(54) DEBRIS TRAP FOR CAPTURING DEBRIS FLOWING IN A STREAM OF LIQUID AND PRIMING ASSEMBLY FOR A PUMP

(71) Applicant: Sulzer Management AG, Winterthur (CH)

(72) Inventors: Kai Haime, Siltakylä (FI); Toni Heikkilä, Kotka (FI)

(73) Assignee: SULZER MANAGEMENT AG, Winterthur (CH)

( * ) Notice: Subject to any disclaimer, the term of this patent is extended or adjusted under 35 U.S.C. 154(b) by 0 days.

(21) Appl. No.: 17/708,563

(22) Filed: Mar. 30, 2022

(65) Prior Publication Data

US 2022/0333616 A1 Oct. 20, 2022

(30) Foreign Application Priority Data

Apr. 16, 2021 (EP) ..... 21168863

(51) Int. Cl.
*F04D 9/04* (2006.01)
*F04D 29/70* (2006.01)
(Continued)

(52) U.S. Cl.
CPC ..... *F04D 29/708* (2013.01); *F04D 9/046* (2013.01); *F04D 9/065* (2013.01); *F04D 29/4293* (2013.01)

(58) Field of Classification Search
CPC ..... F04D 29/708; F04D 9/046; F04D 9/065; F04D 29/4293; F04D 1/00; F04D 7/00;
(Continued)

(56) References Cited

U.S. PATENT DOCUMENTS 2,322,910 A * 6/1943 Adney ..... F04D 9/001 415/24
2,801,592 A * 8/1957 Barton ..... F04D 9/065 137/496

(Continued)

FOREIGN PATENT DOCUMENTS

EP 1024293 A2 8/2000
GB 1157767 A 7/1969
GB 1157767 A * 7/1969 ..... F04D 9/065

OTHER PUBLICATIONS

European Search Report dated Sep. 1, 2021 in corresponding European Application No. 21168863.5.

*Primary Examiner* — Hung Q Nguyen
*Assistant Examiner* — Anthony Donald Taylor, Jr.
(74) *Attorney, Agent, or Firm* — Global IP Counselors, LLP

(57) ABSTRACT

A debris trap for capturing debris flowing in a stream of liquid, the debris trap includes a housing, a fluid inlet channel in connection with a space in the housing, a fluid outlet channel in connection with the space, the fluid outlet channel comprising a fluid outlet port, a float member, a guide element configured to guide movement of the float member when a liquid level in the space changes when in use, a stopper in connection with the fluid outlet port configured to stop the movement of the float member when the liquid level in the space raises, the fluid outlet port which, when the float member is against the stopper, remains partially open and the float member, when brought against the stopper, form a fluid communication path with a reduced area, which restricts the size of the debris capable of flowing through the outlet port.

14 Claims, 6 Drawing Sheets

(51) Int. Cl.
*F04D 9/06* (2006.01)
*F04D 29/42* (2006.01)

(58) Field of Classification Search
CPC ..... F04D 9/00; F04D 9/02; F04D 9/04; F04D 13/066; F04D 13/14; F04D 15/0218; F04D 29/2255
USPC ..... 415/167.1
See application file for complete search history.

(56) References Cited

U.S. PATENT DOCUMENTS 3,904,319 A * 9/1975 Paish ..... F04D 9/001 417/199.2
4,116,582 A * 9/1978 Sloan ..... F04D 9/00 415/177
4,194,893 A * 3/1980 Woodhouse ..... F04D 9/003 96/214
5,536,147 A * 7/1996 Lang ..... F04D 9/041 417/199.2
6,250,889 B1 * 6/2001 Shepard ..... F04D 9/06 417/89
6,783,330 B2 * 8/2004 Carnes ..... F04D 9/043 137/434
7,334,600 B2 * 2/2008 Scott ..... F16K 27/003 137/448

* cited by examiner

Fig. 3A
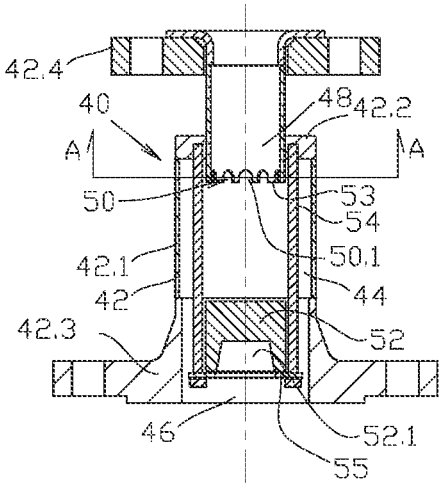
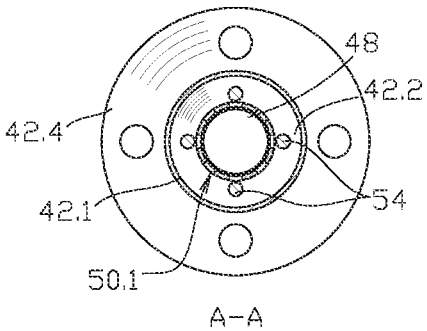
Fig. 3B

DEBRIS TRAP FOR CAPTURING DEBRIS FLOWING IN A STREAM OF LIQUID AND PRIMING ASSEMBLY FOR A PUMP

CROSS-REFERENCE TO RELATED APPLICATION

This application claims priority to European Patent Application No. 21168863.5, filed Apr. 16, 2021, the contents of which are hereby incorporated by reference in their entirety.

BACKGROUND

Field of the Invention

The present disclosure relates to a debris trap for capturing debris flowing in a stream of liquid and a priming assembly for a centrifugal pump.

Background Information

Pumps are mechanical equipment which can lift a fluid from low level to high level or cause fluid to flow from a low pressure area to a high pressure area. Pump priming is the process of removing air from the pump and its suction line. Priming is only not required when the pump is either capable of removing air and gases from itself or the layout conditions are so arranged that the pump will be always adequately filled with the liquid to be pumped.

In the priming process the pump is filled with the liquid being pumped and the liquid forces all the air, gas, or vapor contained in the passageways of pump to escape out.

Conventional pumps can be primed using an ejector or a jet pump. For example, the document EP2481928A1 discloses an ejector in connection with a pump.

Document EP 1024293 A2 discloses a debris trap for capturing debris flowing in a stream of liquid, which debris trap comprises a housing having a space inside the housing, a fluid inlet channel in connection with the space, a fluid outlet channel in connection with the space, the fluid outlet channel comprising a fluid outlet port, a float member arranged in the space, a guide means or device configured to guide the float member's movement as the liquid level in the space changes when in use for capturing debris flowing in a stream of fluid, and a stopper in connection with the fluid outlet port configured to stop the float member's movement as liquid level in the space raises.

SUMMARY

It has been determined that an ejector, or a jet pump, has substantially narrow passageways for the fluid to be pumped. Even if the drive fluid used to operate the jet pump can easily be arranged to be clean enough, using a jet pump, operated for example with pressurized air, in connection with a pump configured to pump liquid which contains debris, can be problematic. It has been found that it is quite probable that the debris can enter into the jet pump and clog the narrow passageways, resulting in disturbance of its operation and failing of the priming of the pump. Likewise, should the priming be performed making use of another kind of source of vacuum, entering of debris, at least debris of greater size, to the source of vacuum is problematic.

An object of the present disclosure is to provide a debris trap for capturing debris flowing in a stream of liquid and a priming assembly for a pump, by which the operation of a priming jet pump is considerably improved compared to the prior art solutions.

Objects of the present disclosure can be met substantially as is disclosed herein which describe in more detail different embodiments of the invention.

In one embodiment, a debris trap for capturing debris flowing in a stream of liquid is provided. The debris trap comprises

- a housing having a space inside the housing,
- a fluid inlet channel in connection with the space,
- a fluid outlet channel in connection with the space, the fluid outlet channel comprising a fluid outlet port,
- a float member arranged in the space,
- a guide element configured to guide the float member's movement as liquid level in the space changes when in use,
- a stopper in connection with the fluid outlet port configured to stop the float member's movement as liquid level in the space raises,
- the fluid outlet port which, when the float member is against the stopper, is configured to remain partially open and the float member, when brought against the stopper, form a fluid communication path with reduced area, which restricts the size of the debris which can flow through the outlet port.

Such a debris trap minimizes escape of debris flowing in a stream of liquid and still causes only minimal pressure loss when used in a priming assembly for a centrifugal pump. The debris trap is particularly for capturing debris floating in a stream of liquid in a priming assembly for a centrifugal pump. In the beginning of priming, the float member is practically not effecting on the transmitting vacuum from the fluid outlet channel to the space of the housing. But, when the float member is against the stopper, the fluid outlet port is configured to remain partially open, and while being fully open, the fluid outlet port cross sectional flow area corresponds to that of the fluid outlet channel. When the float member and the fluid outlet port are brought into effect with each other, size of the debris which can flow through the outlet port is restricted, even though the flow communication is open and vacuum is still transmitted from the fluid outlet channel to the space in the housing.

Such a debris trap minimize escape of debris flowing in a stream of liquid and causes only minimal pressure loss when used in a priming assembly.

According to an embodiment of the invention the float member, when brought against the stopper, form a fluid communication path between float member and the fluid outlet port having an area of 5-90% of the area of the fluid outlet channel. Such a debris trap, in addition to minimizing escape of debris flowing in a stream of liquid and causing only minimal pressure loss when used in a priming assembly for a centrifugal pump, minimizes possible agglomeration of debris in the trap.

According to an embodiment of the invention the float member, when brought against the stopper, form a fluid communication path which creates pressure difference between the space in the housing and the fluid outlet channel. The pressure difference can be utilized for detecting the state of the priming process since when the float member is against the stopper, the priming has been completed.

According to an embodiment of the invention the float member, when brought against stopper, form a fluid communication path between float member and the fluid outlet port comprising at least two distinct flow paths. Providing a number of small, separate flow paths to form the fluid communication makes it possible to restrict escape of debris through the trap, and still causing only minimal pressure loss when used in a priming assembly for a centrifugal pump. By the distinct flow path it is possible to determine the size of the debris which is caught by the trap and problems caused by the debris to a source of vacuum can be minimized.

According to an embodiment of the invention the least two distinct flow paths comprise axial notches arranged to an inlet edge of the fluid outlet port. Arranging the flow path by downwardly open axial notches in the edge of the fluid outlet minimize the possibility of agglomeration of debris to the fluid outlet port since, after the space of the housing of the debris trap has emptied from the liquid the float member moves away from the fluid outlet and any debris can fall down and be conveyed with the liquid away.

Depending on the case, decreasing the fluid communication through the fluid outlet port, when the float member and the fluid outlet port are brought into effect with each other, can be accomplished also such that the least two distinct flow paths comprise holes arranged to extend from a side wall of the float member to a top wall of the float member.

According to an embodiment of the invention the least two distinct flow paths comprise holes arranged to the fluid outlet channel.

The guide element is advantageously a linear guide, which provides a reliable operation and simple construction of the debris trap.

According to an embodiment of the invention the guide element comprises at least three guide bars spaced around the outlet between which the float member is slidably supported.

According to an embodiment of the invention the element means is an external guide to the float member. This way the outlet port flow area can be set effectively.

According to an embodiment of the invention the guide element comprises a retainer coupled to the at least three guide bars at a distance from the outlet and the float member is arranged between guide bars and the retainer.

According to an embodiment of the invention the guide element comprises radial extensions, which extend from the float member towards inner wall of the housing of the debris trap.

Priming assembly according to the invention for a pump, which pump comprising a suction side and discharge side, the assembly comprises a source of vacuum controllably connected to the suction side of the pump, and a debris trap according to anyone of the embodiments herein, wherein the fluid outlet channel of the debris trap is connected between the source of vacuum and the suction side of the pump.

Priming assembly according to an embodiment the invention for a pump, which pump comprises a suction side and discharge side, wherein the source of vacuum comprising a jet pump having

- a first inlet for the priming fluid for connecting the assembly to a suction side of the pump
- a second inlet for drive fluid for connecting the assembly to source of pressurized drive fluid and
- an outlet for discharging the priming fluid and the drive fluid from the jet pump, and a debris trap according to anyone of the embodiments herein, wherein the fluid outlet channel of the debris trap is connected to the first inlet of the jet pump.

The priming assembly is particularly advantageous for use in priming of a centrifugal pump.

Embodiments of the present invention can also provide the following advantageous effect when using the air as the drive fluid. When the fluid communication path with reduced area, which is formed when the float member is brought against the stopper, is dimensioned suitably, it is possible to prevent an excess amount of liquid from entering the jet pump throat. This way a throat of the jet pump will not be clogged by the liquid, not even temporarily. If the throat becomes clogged, the drive fluid, that is the air, will find its way into the suction side of the pump via the debris trap. This is particularly undesirable in terms of operation of the pump when the working fluid is compressed air.

In this application the word vacuum should not be understood to mean an absolute vacuum, like a space devoid of matter, but merely a partial vacuum at suitable level providing required technical effect in the sense of embodiments of the present invention.

The exemplary embodiments of the invention presented in this patent application are not to be interpreted to pose limitations to the applicability of the appended claims. The verb "to comprise" is used in this patent application as an open limitation that does not exclude the existence of also unrecited features. The features recited in depending claims are mutually freely combinable unless otherwise explicitly stated. The novel features which are considered as characteristic of the invention are set forth in particular in the appended claims.

BRIEF DESCRIPTION OF DRAWINGS

The invention will be explained in more detail hereinafter with reference to the drawings.

FIGS. 3A and 3B illustrate a debris trap according to another embodiment of the invention.

DETAILED DESCRIPTION

Figure 1:
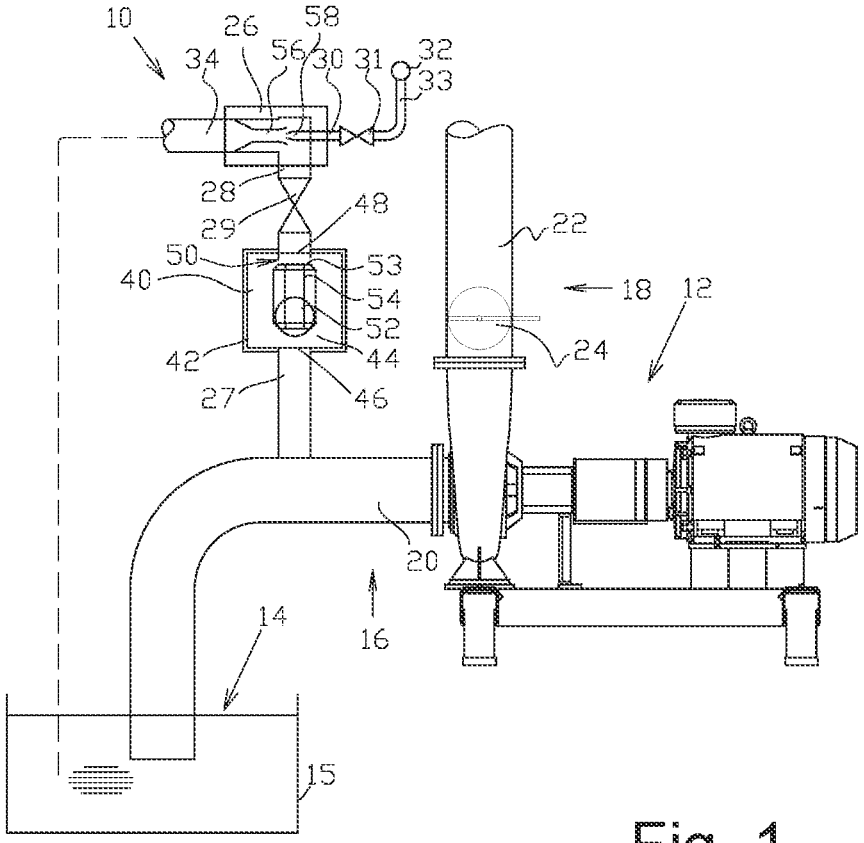
FIG. 1 illustrates a priming assembly for a pump according to an embodiment of the invention.

FIG. 1 depicts schematically a priming assembly 10 for a pump 12. A centrifugal pump is a pump type which requires priming in order to start pumping process. In normal conditions, common centrifugal pumps are unable to evacuate the air from an inlet line leading to a liquid surface level 14 of liquid storage 15 which is vertically below that of the pump 12. The pump has a suction side 16 and discharge side 18, more particularly the pump includes a suction pipe 20 and a discharge pipe 22 which are connected to the pump 12. The discharge pipe 22 includes a discharge valve 24. The priming assembly further comprises a jet pump 26 which is arranged vertically above the centrifugal pump 12. The jet pump 26, often an ejector, is known as such for a skilled person in the art. In an ejector, a drive fluid flows through a jet nozzle 58 into a tube that first narrows and then expands in cross-sectional area, which is referred to as a throat 56. The high velocity drive fluid mixes with the liquid that is drawn in by the vacuum created by the ejector. The strength of the vacuum produced depends on the velocity of the drive fluid and shape of the fluid jet and the shape of the throat and mixing sections downstream the throat 56. The jet pump is a very compact device in size and has no moving parts and is therefore advantageous for the purpose of priming the pump 12.

The jet pump 26 comprises a first inlet 28 for the priming liquid. The priming assembly 10 comprises a priming conduit 27 which connects the pumps 12 suction side 16 to the first inlet 28. There is a first control valve 29 arranged to the priming conduit 27 connected to the first inlet 28. The first inlet is thus connected to the suction side 16 of the pump 12. The connection to the suction side means that the actual connection is provided to the suction pipe 20 or to the pump 12 itself at a location that the impeller housing will be filled with liquid when the jet pump is operated during the priming process. The jet pump 26 comprises further a second inlet 30 for drive fluid. The second inlet 30 for the drive fluid is connected to source of pressurized drive fluid 32 by a feed pipe 33. There is a second control valve 31 connected to the second inlet 30. In this connection the drive fluid is advantageously pressurized air, and the source of pressurized drive fluid is a source of pressurized air. The jet pump 26 comprises further an outlet 34 for discharging the priming liquid and the drive fluid from the jet pump 26. The outlet 34 is advantageously connected to the liquid storage 15.

The priming assembly comprises further a debris trap 40 arranged to the priming conduit 27 between the suction pipe 20 and the jet pump 26. Here the priming conduit 27 is coupled to the upper-most location of the suction pipe 20. The debris trap 40 is arranged to capture debris flowing in a stream of priming liquid towards the jet pump 26. The debris trap 40 is positioned in a vertical level above the pump's shaft, advantageously above the impeller of the pump 12. The first control valve 29 is between the debris tramp 40 and the jet pump 26 in FIG. 1, but the debris trap 40 can also be arranged between the first control valve and the debris trap 40. By the debris trap 40 it is ensured that the jet pump will not become clogged. FIG. 1 shows a debris trap 40 in an extremely exemplary manner for purposes of understanding the main functions of the trap 40. The debris trap 40 comprises a housing 42 in which a space 44 is arranged inside the housing. The housing includes a liquid inlet channel 46 in connection with the space 44 The priming conduit 27 connected to the fluid inlet channel 46. There is a fluid outlet channel 48 arranged to the upper part of the housing 42, in connection with the space 44. The fluid outlet channel 48 comprises a fluid outlet port 50 which provides fluid communication between the space 44 and the fluid outlet channel 48.

Figure 2:
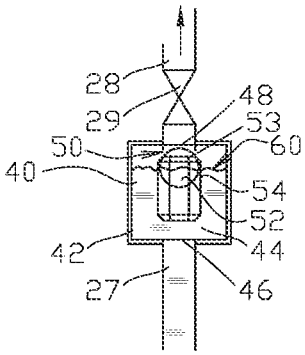
FIG. 2 illustrates a debris trap of the FIG. 1 during the priming process.

There is a float member 52 arranged in the space 44 of the housing 42. The debris trap 40 further includes a guide means or element 54 in the space 44. The guide element 54 comprises linear guides, such as bars, arranged to extend vertically around the guide element 54. The guide element 54 is external to the float member 52. The debris trap 40 includes a stopper 53 arranged in the space 44 at an upper end of the guide element 54. The stopper 53 is in connection with the fluid outlet port 28 and it is configured to stop the float member's movement, as liquid level in the space rises in the space 44, before the fluid outlet port closes totally. The float member 52 in FIGS. 1 and 2 is a spherical ball having a slanted top regardless of its position. The float member 52 is arranged to be guided by the guide element 54 into operational contact, and from operational contact, with the fluid outlet port 50 as the liquid level in the space 44 changes vertically when in use to capture debris flowing in a stream of liquid during the priming operation of the assembly 10. The float member 52, the guide element 54 and the fluid outlet port 50 together control fluid communication from the space 44 to the fluid outlet channel 48 of the debris trap 40. The float member 52 and the fluid outlet port 50, when the float member, more particularly its upper end, is brought against the stopper 53, decrease effective cross sectional flow area of fluid communication through the fluid outlet port, which is thus configured to remain partially open, when the float member 52 is against the stopper 53. Depending on the practical case, the fluid outlet port is decreased so as to have an area of 5-90% of the area of the fluid outlet channel, but it does not totally close the flow connection from the space 44 to the fluid outlet channel 48.

When the float member 52 is against the stopper 53 the flow communication through the outlet port remains partially open with a restricted area and therefore the size of the debris which can flow through the outlet port 50 is restricted, even though the flow communication is open and vacuum is still transmitted from the fluid outlet channel 48 to the space 44.

The priming assembly 10 functions in a following manner, applicable to all embodiments of the debris trap. After the pump 12 has been stopped and it has been emptied from the pumped liquid i.e. the pump is filled with the air. When the pump is desired to be started the priming steps are executed as follows. First, the discharge valve 24 is closed separating the discharge pipe 22 from the pump 12. Next, the second control valve 31 is opened which connects the source of pressurized air to the jet pump 26. Pressurized air is led to the jet pump 26 and out through the outlet 34. The first control valve 29 is now opened. This starts the operation of the jet pump. Vacuum is generated to the first inlet 28 of the jet pump and liquid begins to rise up from the liquid storage 15 to the suction pipe 20. After the jet pump has been operating for a while, the liquid surface rises up to the debris trap 40 and the liquid level is thus so high that the pump housing is also filled with the liquid. Adequate level of the liquid can be detected in the debris trap. Now the pump 12 can be started and the discharge valve 24 opened. The first valve 29 of the jet pump can now be closed and also the introduction of the pressurized air can be stopped.

The priming assembly is advantageous for use in practical applications where the liquid, such as water, contains small, debris in it, wherein the debris trap is configured particularly to capture debris floating in a stream of liquid. When priming a pump, the most problematic debris is floating debris which does not experience gravity force substantially greater than the buoyance caused by the liquid. Floating debris can be floating on the surface of the liquid or it can be partially or fully submerged in the liquid.

Such applications where the liquid contains small debris can be found for example in the forest industry, and waste treatment processes, just to mention a few. In FIG. 2, which shows a debris trap 40 of FIG. 1 during the priming process, the liquid level has risen up to the debris trap 40 which is under the effect of the under-pressure created by the jet pump 26. The float member 52 has moved upwards from its lower position (the lowest position shown in FIG. 1), where the air flow into the fluid outlet channel 48 is practically unaffected by the float member 52, under guidance of the guide element 54 to its uppermost position (the position shown in FIG. 2), where float member 52 and the fluid outlet port 50 are brought into effect with each other. The float member is against the stopper 53. In this embodiment the fluid outlet port 50 reduces to a narrow slot formed between the float member 52 and the end of the fluid outlet channel 48. This embodiment prevents entry of substantially compact debris into the jet pump, but can allow an escape of substantially elongated debris which has its diagonal dimension smaller than the slot. The float member 52 has a predetermined buoyancy in the liquid in question, such that its uppermost point raises above the liquid level 60 when it is floating freely. The actual height of the float member 52 above the liquid level is determined by knowledge or assessment of quantity and/or quality, such as size, of the debris present in the liquid. Advantageously the float is configured to extend more than 5 mm above the liquid surface 60. Typically, the float member 52, having an axial length in the direction of its guided movement in the space, has a portion of less than 50% of its axial length above the surface of the liquid.

As a first measure, since the float member extends above the surface liquid surface level, the float member is guided by the guide element 54 to move to in front of the fluid outlet port 50 before the rising liquid. This alone decreases the possibility of larger debris escaping through the fluid outlet port 50. As a next measure, since the float member 52 is guided by the guide element 54 to move towards the fluid outlet port 50, without totally closing the fluid communication through the fluid outlet port 50, the jet pump still effects on the space 44 of the debris trap 40 and the priming conduit 27, maintaining the liquid up in the priming conduit 27, suction pipe 20 and the pump housing 12. This position is shown in the FIG. 2. Here the float member 52 and the fluid outlet port 50, when brought facing to, or into effect with each other, form a fluid communication path having a reduced area for a fluid communication. The area is determined to be such that any possibly escaping debris has so small size that it does not clog up the jet pump 26.

Even if a spherical float member, as is shown in FIGS. 1 and 2, can operate adequately in some practical applications, for certain type of debris, FIGS. 3A and 3B show another embodiment, which is an improved form of the debris trap 40 of FIGS. 1 and 2. The debris trap 40 shown in FIGS. 3A and 3B is installed in the priming assembly in similar way as the one shown in FIG. 1. It also operates in a corresponding manner. More particularly, the debris trap 40 comprises a tubular housing 42 having a space 44 inside the housing. The housing is formed by a tube part 42.1 which includes an end plate 42.2 at an upper end of the tube part 42.1. The end plate 42.2 has a fluid outlet 48 arranged coaxially with the tube part 42.1.

The housing includes a liquid inlet channel 46 which is formed by a first flange 42.3. The first flange is rigidly connected to the tube part 42.1. The tube part 42.1 and the first flange 42.3 have substantially equal inner diameters forming a cylindrical space 44 in the housing 42. The fluid outlet channel 48 is a pipe which is arranged extend through the end plate 42.2 into the space 44. The fluid outlet channel 48 has smaller diameter than the tube part 42.1 such that an annular space is formed between the fluid outlet channel 48. The fluid outlet channel 48 comprises a fluid outlet port 50 which provides fluid communication between the space 44 and the fluid outlet channel 48. The fluid outlet channel comprises further a flange 42.4 at its upper end, rotatably assembled in respect to the outlet channel 48. The housing structure shown in FIGS. 3A and 3B can include a float member 52 shown in FIGS. 1 and 2.

Also, in the improved form of the debris trap there is a float member 52 arranged in the space 44 of the housing 42, which is arranged to move vertically under control of guide element 54 in the space 44. The float member is substantially cylindrical having a lightening recess 52.1 at its bottom, which is the opposite end to the one configured to cooperate with the stopper 53. By the lightening recess 52.1 it is possible to adjust and set the height of the float member 52 above the liquid surface, while axial length of its side wall provides adequate guidance from the guide element. The guide element comprises linear bars 54 arranged to extend vertically downwards from the end plate 42.2. Each guide bar 54 is fixed to lower surface of the end plate 42.2 evenly around the fluid outlet 48. The lower end of formed set of guide bars, which can also be referred to as a cage, has a retainer ring 55 at its lower end. The guide bars 54 form an external guide to the float member 52. The retainer ring 55 has an opening at its center area for increasing flow area in the space 44 at the axial location of the retainer ring 55. The retainer ring 55 keeps the float member 52 inside the cage. FIGS. 3A and 3B show four guide bars 54 but even three spaced guide bars results in proper guidance for a cylindrical float member 52 and therefore the presented four guide bars can be replaced with a setup of three guide bars.

The float member 52 is arranged to be guided by the guide bars 54 into contact, and from contact, with the fluid outlet port 50 as the liquid level in the space 44 changes vertically when in use for capturing debris flowing in a stream of liquid during the priming operation of the assembly 10. The end of the fluid outlet channel 48 is also the stopper 53 for the upwards movement of the float member 52. The fluid outlet port 50 comprise several axially extending notches 50.1 arranged to the inlet edge of the fluid outlet channel 48. This way the outlet port, when the float member 52 is against the stopper 53, comprises several separate, or distinct flow paths. Here the distal ends of the notches form the stopper 53. The float member 52, the guide element 54 and the notches 50.1 of the fluid outlet port 50 together control fluid communication from the space 44 to the fluid outlet channel 48 of the debris trap 40. Now the notches have an axial depth which is substantially equal to its width. This way the embodiment prevents escape of substantially compact debris, and also prevents efficiently escape of substantially elongated debris which has its diagonal dimension smaller than the slot.

Figure 4:
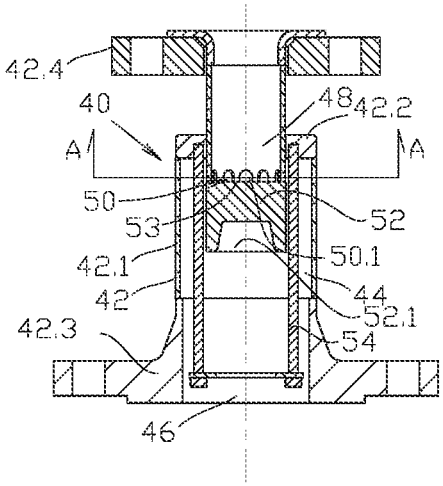
FIG. 4 illustrates a debris trap of the FIG. 3 during the priming process.

In FIG. 4 liquid level has risen up to the debris trap 40 under the effect of the under-pressure created by the jet pump 26. The float member 52 has moved upwards from its lowest position (the situation in FIG. 3), where the air flow into the fluid outlet channel 48 is unaffected by the float member 52, under guidance of the guide element 54 to its uppermost position (the situation in FIG. 4), where float member 52 and the fluid outlet port 50 are brought into effect with each other. The float member has a predetermined buoyancy in the liquid in question, such that is uppermost point raises above the liquid level 60. The actual height of the float member 52 above the liquid level is determined by knowledge or assessment of quantity and/or quality, such as size, of debris present in the liquid. Advantageously the float is configured to more than 5 mm above the liquid surface 60.

The float member 52, when the float member is brought against the stopper 53, decreases fluid communication through the fluid outlet port such that the separate notches have a common area of 5-90% of the area of the fluid outlet channel, but does not totally close the flow connection from the space 44 to the fluid outlet channel 48.

Also, in the embodiment of FIGS. 3A, 3B and 4 the float member extends above the surface liquid surface level, when floating freely, and the float member is guided by the guide element 54 to move to in front of the fluid outlet port 50 before the rising liquid can reach the outlet port 50. This alone decreases the possibility of larger debris escaping through the fluid outlet port 50. As a next measure, since the float member 52 is guided by the guide bars 54 to move against the stopper, without totally closing the fluid communication through the fluid outlet port 50, the jet pump still effects on the space 44 of the debris trap 40 and the priming conduit 27 maintaining the liquid up in the priming conduit 27, suction pipe 20 and the pump housing 12. This position is shown in the FIG. 4, where the float member 52 and the fluid outlet port 50, when brought to face each other, form a fluid communication path having an area for a fluid communication. In FIGS. 3A, 3B and 4 the float member 52, when brought against the stopper 53, form a fluid communication path comprising at least two distinct flow paths. The distinct flow paths are formed by the notches in rim the fluid outlet channel 48. The area of each distinct flow path is determined to be such that any possibly escaping debris has so small size that it does not clog up the jet pump 26. In practice this can be achieve for example such that the area of each distinct flow path is smaller than the area of the throat of the jet pump.

Figure 5:
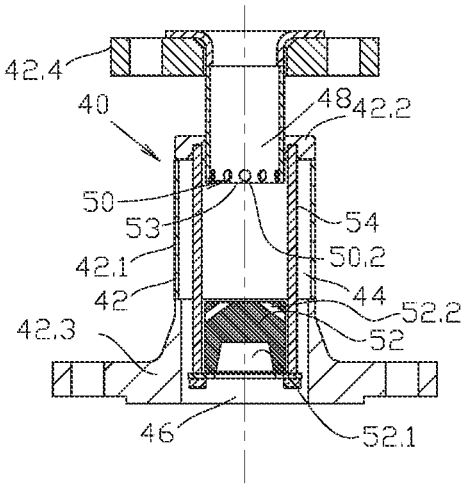
FIG. 5 illustrates a debris trap according to still another embodiment of the invention.

FIG. 5 shows another embodiment which is otherwise similar to that in FIGS. 3A, 3B and 4 except that instead of the notches, the outlet channel 48 includes holes 50.2, preferably round holes, arranged near the edge of the channel 48. The holes are arranged at a small distance from the edge which is smaller than the diameter of the holes. Alternatively or additionally to other embodiment which result in decreasing the area of the fluid communication port 50 when the float member 52 and the fluid outlet port 50 are brought into effect with each other, FIG. 5 describes holes 52.2 arranged to extend from a side wall of the float member to a top wall of the float member, forming least two distinct flow paths in the fluid communication port. The area of each distinct flow path, i.e. the holes, is determined to be such that any possibly escaping debris has such a small size that it does not clog up the jet pump 26.

Figure 6:
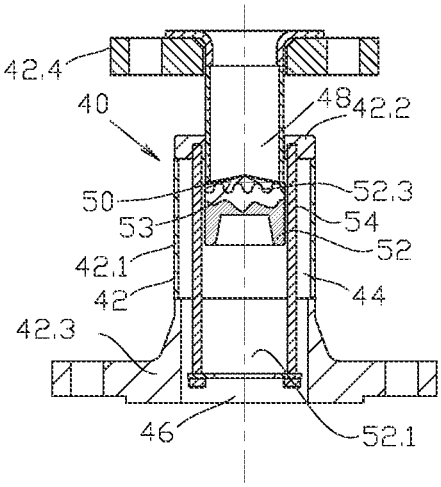
FIG. 6 illustrates a debris trap according to still another embodiment of the invention.

FIG. 6 shows another embodiment which is otherwise similar to that in the FIGS. 3A and 3B and 4 except that instead of the notches being arranged to the outlet channel 48, the float member 52 includes radial grooves 52.3 at its upper end. The grooves extend from the side wall of the float member 52 towards its center. The top end can be slanted to improve removal of debris from the top of the float member 52. Also in the other embodiments described the top of the float member can be slanted of conical.

Figure 7:
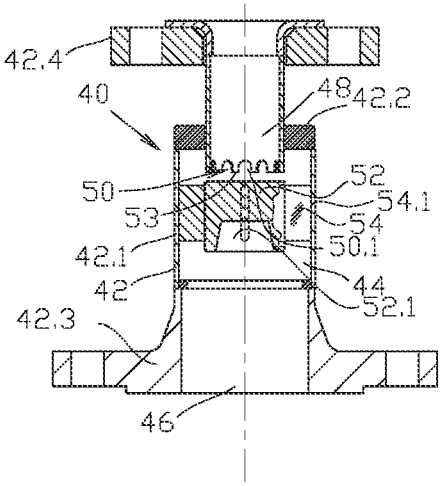
FIG. 7 illustrates a debris trap according to still another embodiment of the invention.

FIG. 7 shows still another embodiment which is otherwise similar to that in FIGS. 3A, 3B and 4, except that the guide element 54 is integrated to the float member 52 replacing the guide bars. The guide element comprises radial extensions, which extend from the float member 52 towards an inner wall of the housing 42 of the debris trap 40. The radial extension has a guide surface 54.1 parallel to the inner surface of the space 44 of the housing 42. The guide surface 54.1 can be comprised of outer edges of several separate extensions. The guide element can also comprise a sleeve (not shown) arranged against the inner surface of the space 44 connected with radial supports to the float member 52. It is also conceivable to arrange the float means or member 52 such that its diameter is so large that it takes its guidance directly from the inner surface of the space 44 and provided with axial flow through channels with adequate area radially outside the region of the fluid outlet channel 48.

Figure 8:
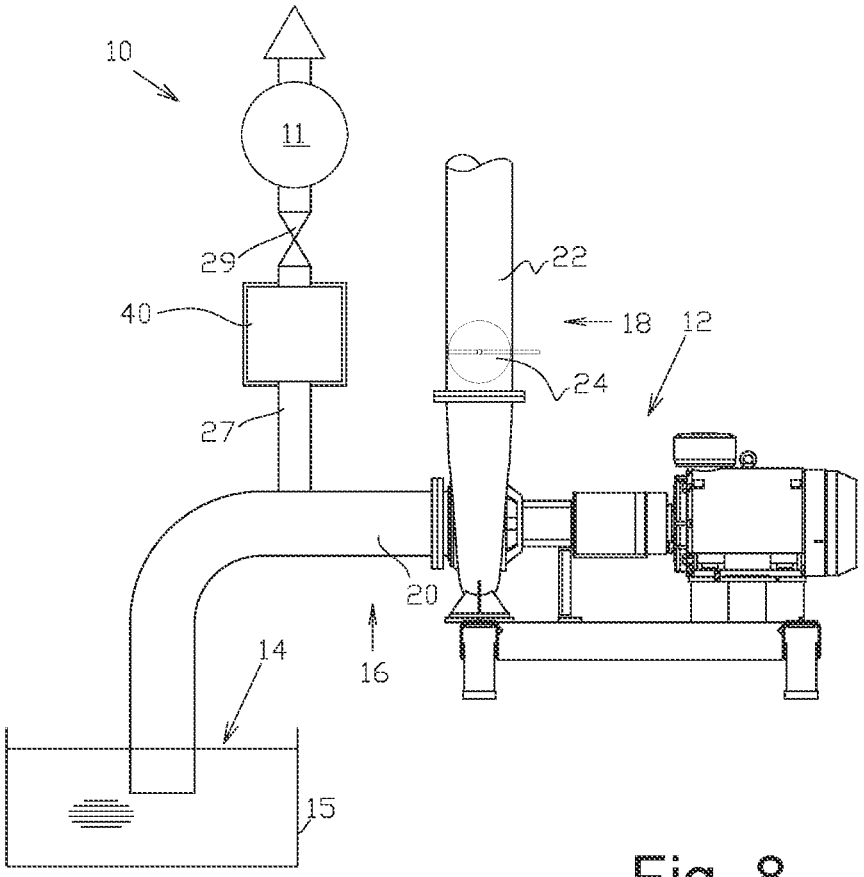
FIG. 8 illustrates a priming assembly for a pump according to another embodiment of the invention.

FIG. 8 discloses schematically a priming assembly 10 for a pump 12. A centrifugal pump is a pump type which requires priming in order to start a pumping process. In normal conditions, common centrifugal pumps are unable to evacuate the air from an inlet line leading to a liquid surface level 14 of liquid storage 15 which is vertically below that of the pump 12. The pump has a suction side 16 and discharge side 18, more particularly the pump includes a suction pipe 20 and a discharge pipe 22 which are connected to the pump 12. The discharge pipe 22 includes a discharge valve 24. The priming assembly further comprises a source of vacuum 11. The source of vacuum can be for example an ejector, a vacuum pump, blower or even a general vacuum system, such as a paper machine vacuum system. The source of vacuum 11 is connected to the suction side 16 of the pump 12. The connection to the suction side means that the actual connection is provided to the suction pipe 20 or to the pump 12 itself at a location that the impeller housing will be filled with liquid when source of vacuum is in flow connection, controlled by a valve 29, with the suction side of the pump.

The priming assembly further comprises a debris trap 40 arranged to the priming conduit 27 between the suction pipe 20 and the source of vacuum 11. Here the priming conduit 27 is coupled to the upper-most location of the suction pipe 20. The debris trap 40 is arranged for capturing debris flowing in a stream of priming liquid towards the jet pump 26. The debris trap 40 is positioned to a vertical level above the pump's shaft, advantageously above the impeller of the pump 12. The first control valve 29 is between the debris trap 40 and the source of vacuum 11. By the debris trap 40 it is ensured that only debris of limited size can proceed towards the source of vacuum 11. FIG. 8 shows a debris trap 40 in extremely exemplary manner for purposes of understanding the main functions of the trap 40, and it can be constructed according to anyone of the embodiments of the debris trap described here, and modified within the skills of a person in the art.

Figure 9:
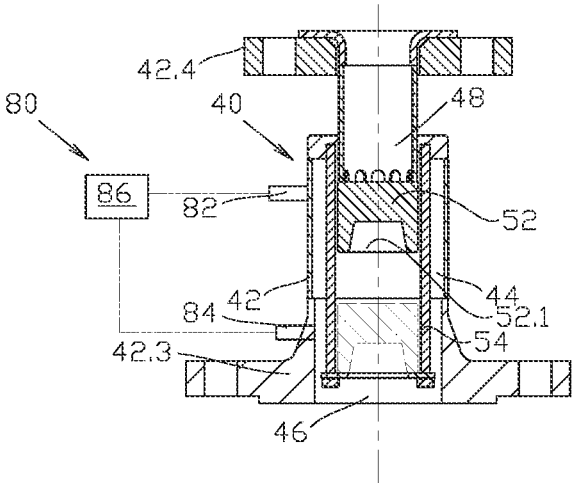
FIG. 9 illustrates a debris trap according to another embodiment of the invention.

FIG. 9 discloses a further developed embodiment of the invention, The debris trap 40 shown in FIG. 9 is installed in the priming assembly in a similar way as the one shown in FIG. 1. It is otherwise similar to the embodiment that is shown in FIGS. 3A and 3B but including a device or means for determining a position 80 of the float member 52 in the housing 42. The device for determining a position 80 of the float member is utilized for detecting the level of the liquid in the priming assembly 10 such that the state of priming is reliably recognized. The device for determining the position 80 of the float member comprises at least a first sensor 82 which detects the state where the float member 52 is against the stopper 53. There can be optionally a second sensor 84 which detects the state where the float member 52 off from the stopper 53, in other words it is not against the stopper. The type of proximity sensor can be selected as required by the practical solution, and it can be e.g. type of capacitive, magnetic, radar or sonar, just to mention a few feasible types of such sensors. The device for determining position 80 of the float member can also comprise a dedicated electronic control unit 86 to process signals provided by the sensor or the sensors into more usable form, if so desired. When the level of the liquid is reliably determined function of the priming assembly 10 is more efficient because unnecessary delay between starting of jet pump and start of pump is avoided. The device for determining position 80 of the float member can be arranged to practically any embodiment, regardless of the actual design of the float member 40.

While the invention has been described herein by way of examples in connection with what are, at present, considered to be the most preferred embodiments, it is to be understood that the invention is not limited to the disclosed embodiments, but is intended to cover various combinations or modifications of its features, and several other applications included within the scope of the invention, as defined in the appended claims. The details mentioned in connection with any embodiment above can be used in connection with another embodiment when such combination is technically feasible.

What is claimed:

1. A debris trap for capturing debris flowing in a stream of liquid, the debris trap comprising:

a housing having a space inside the housing;

a fluid inlet channel in communication with the space;

a fluid outlet channel in communication with the space, the fluid outlet channel comprising a fluid outlet port;

a float member;

a guide to guide a movement of the float member when a liquid level in the space changes;

a stopper in connection with the fluid outlet port, the stopper configured to stop the movement of the float member when the liquid level in the space rises, wherein the fluid outlet port, when the float member is against the stopper, is configured to remain partially open, such that the float member, when brought against the stopper, forms at least one fluid communication path with a reduced area which is configured to restrict a size of the debris capable of flowing through the fluid outlet port.

2. The debris trap according to claim 1, wherein the float member, when brought against the stopper, forms the at least one fluid communication path between the float member and the fluid outlet port with a reduced area of 5-90% of an area of the fluid outlet channel.

3. The debris trap according to claim 1, wherein the float member, when brought against the stopper, forms the at least one fluid communication path to create a pressure difference between the space inside the housing and the fluid outlet channel.

4. The debris trap according to claim 1, wherein the at least one fluid communication path comprises at least two distinct flow paths.

5. The debris trap according to claim 4, wherein the at least two distinct flow paths comprise a plurality of axial notches arranged at an inlet edge of the fluid outlet port.

6. The debris trap according to claim 4, wherein the at least two distinct flow paths comprise a plurality of holes arranged to extend from a side wall of the float member to a top wall of the float member.

7. The debris trap according to claim 4, wherein the at least two distinct flow paths comprise a plurality of holes arranged at the fluid outlet port.

8. The debris trap according to claim 1, wherein the guide is a linear guide.

9. The debris trap according to claim 8, wherein the guide comprises at least three guide bars spaced around the fluid outlet channel, the float member slidably supported between the at least three guide bars.

10. The debris trap according to claim 9, wherein the guide comprises a retainer coupled to the at least three guide bars at a distance from the fluid outlet port, the float member arranged between the at least three guide bars and the retainer.

11. The debris trap according to claim 1, wherein the guide comprises a plurality of radial extensions extending from the float member towards an inner wall of the housing.

12. A priming assembly for a centrifugal pump, the pump comprising a suction side and a discharge side, the priming assembly comprising:

a vacuum source connected to the suction side of the pump; and the debris trap according to claim 1, wherein the debris trap is connected between the vacuum source and the suction side of the pump.

13. The priming assembly for the centrifugal pump according to claim 12, wherein the vacuum source comprises:

a jet pump having a first inlet for a priming fluid, a second inlet for a drive fluid, and a jet pump outlet to discharge the priming fluid and the drive fluid from the jet pump, wherein the fluid outlet channel of the debris trap is connected to the first inlet of the jet pump.

14. The priming assembly for the centrifugal pump according to claim 13, wherein the at least one fluid communication path comprises several distinct flow paths, each distinct flow path having an area that is smaller than an area of a throat of the jet pump.

* * * * *